US006140771A

United States Patent [19]

Luger et al.

[11] Patent Number: 6,140,771

[45] Date of Patent: Oct. 31, 2000

[54] METHOD AND DEVICE FOR DETECTING THE RECTIFICATION EFFECT THAT OCCURS IN A GAS DISCHARGE LAMP

[75] Inventors: Siegfried Luger, Dornbirn; Thomas Marinelli, Wolfurt; Falk Richter, Dornbirn, all of Austria

[73] Assignee: Tridonic Bauelemente GmbH, Dornbirn, Austria

[21] Appl. No.: 09/387,837

[22] Filed: Sep. 1, 1999

Related U.S. Application Data

[63] Continuation of application No. PCT/EP98/00791, Feb. 12, 1998.

[30] Foreign Application Priority Data

Mar. 4, 1997 [DE] Germany ..... 197 08 792

[51] Int. Cl.[7] ..... H05B 39/00

[52] U.S. Cl. ..... 315/101; 315/307; 315/DIG. 7; 315/224

[58] Field of Search ..... 315/101, 219, 315/224, 225, 307, DIG. 7, 209 R, 244, 291, 283, 278, 276, 205, 207, 106, 107, DIG. 4, DIG. 5

[56] References Cited

U.S. PATENT DOCUMENTS 4,910,438 3/1990 Farnsworth ..... 315/241 R
5,023,516 6/1991 Ito et al. ..... 315/101
5,475,284 12/1995 Lester et al. ..... 315/209 R
5,747,941 5/1998 Shackle et al. ..... 315/224
5,808,422 9/1998 Venkitasubrahmanian et al. ... 315/225

FOREIGN PATENT DOCUMENTS

0338109A1 10/1989 European Pat. Off. .
0490329A1 6/1992 European Pat. Off. .

*Primary Examiner*—Don Wong
*Assistant Examiner*—Tuyet T. Vo
*Attorney, Agent, or Firm*—Fitzpatrick, Cella, Harper & Scinto

[57] ABSTRACT

Method for detecting the rectification effect in at least one gas discharge lamp (10) and electronic ballast for operating at least one gas discharge lamp, which recognises the appearance of the rectification effect in the gas discharge lamp (10). In order to be able to detect the appearance of the rectification effect in the gas discharge lamp (10) simply and with high sensitivity there is monitored the current ($i_1$) flowing via a primary winding (7A), connected parallel to the gas discharge lamp (10), of a heating transformer (7A–C) or a parameter ($i_2$, $u_3$) dependent upon this current ($i_1$) , and in the event that a predetermined limit value is overshot the presence of the rectification effect in the gas discharge lamp (10) is determined.

23 Claims, 5 Drawing Sheets

METHOD AND DEVICE FOR DETECTING THE RECTIFICATION EFFECT THAT OCCURS IN A GAS DISCHARGE LAMP

CROSS REFERENCE TO RELATED APPLICATIONS

This is a continuation of co-pending International Application No. PCT/EP98/00791, filed Feb. 12, 1998.

BACKGROUND OF THE INVENTION

1. Field of the Invention

The present invention relates to an electronic ballast for operating at least one gas discharge lamp wherein the gas discharge lamp is supplied with an alternating voltage and wherein the lamp filaments are preheated.

2. Description of the Related Art

Such a ballast is known from EP-A1-0 490 329.

As in the case of other lamps as well, in the case of gas discharge lamps on account of the phenomena of wear of the heater filaments at the end of the life of the gas discharge lamp the effect that occurs is one where the lamp electrodes wear unevenly over time, that is, the erosion of the emitting layers on the lamp electrodes is different. On account of the differing wear of the lamp electrodes, differences result in the emitting power of the two lamp electrodes.

FIG. 5 shows the consequences of this effect with reference to the current $i_L$ that is fed to the gas discharge lamp. It can be seen from FIG. 5 that a higher current flows in the one direction than in the other so that the time characteristic $i_L(t)$ has an excess of one half-wave (in FIG. 5 the positive half-wave) . As a result of the different erosion of the two lamp electrodes, asymmetries thus result that not only give rise to comparatively great light-flickering at the end of the life of the gas discharge lamp, but even in the extreme case also only permit operation of the gas discharge lamp during one half-wave (in FIG. 5 during the positive half-wave). In this case, the gas discharge lamp acts as a rectifier so that the previously described effect is termed a "rectification effect".

The work function for the electrons is higher at that electrode which has worn away to a greater extent in the course of time than at the other electrode which has worn away to a lesser extent. The minimum energy required to draw an electron out of a metal, in the present case out of the lamp electrode, is generally termed the work function. The dipole layer at the surface of the metal, that is, the lamp electrode, is then an important factor in determining the work function. The electrode that has worn away to a greater extent and which has a higher work function for the electrons than the electrode which has worn away to a lesser extent consequently heats up to a greater extent when the gas discharge lamp is put into operation than the opposing electrode. The increase in temperature in the electrode can be so great, in particular in the case of lamps with a small diameter, that portions of the glass lamp bulb can melt. In order to avoid the risk of an accident resulting from the increase in temperature of the glass lamp bulb, consequently it is necessary to identify the rectification effect and, if applicable, switch off the gas discharge lamp or reduce its power input, in which case there are already mandatory standards for monitoring the previously described uneven emission of the lamp electrodes.

As has already been mentioned above, the rectification effect manifests itself in asymmetry of the lamp current $i_L$ flowing by way of the gas discharge path of the lamp. one possibility for identifying the rectification effect is therefore to monitor the lamp current flowing by way of the gas discharge path of the lamp, in which case with this method it is certainly possible to identify differences in emission of the lamp electrodes directly, but the evaluation of these emission differences and also the translation of this identification process into a monitoring circuit arrangement that is designed as an integrated circuit, in particular as an application specific circuit (ASIC), are problematic. As an alternative to this, it is also possible to identify the rectification effect by monitoring the lamp voltage, since the asymmetries occurring in the lamp current are transferred to the lamp voltage. If, for example, the monitored lamp voltage exceeds a specific limiting value in one direction as a consequence of the asymmetrical emission of the lamp electrodes, the gas discharge lamp is switched off. In the case of this identification process, however, it is disadvantageous that the sensitivity of this method is limited, since in the case of a fault, that is, if the rectification effect occurs, the peak value of the lamp voltage that is detected is merely 60% higher than its value in the normal operating case. Moreover, even when the gas discharge lamp is dimmed, the lamp voltage is changed so that on account of the dimming of the gas discharge lamp and on account of the lamp voltage that rises in a corresponding manner as a result, it may possibly be concluded by mistake that the rectification effect is present in the gas discharge lamp. Furthermore, it would be desirable to use the changing arithmetical mean value of the monitored circuit variable for the detection of the rectification effect. This is not a possibility, however, when monitoring the lamp voltage, since—as already described—in the case of a fault the peak value of the lamp voltage is merely increased by 60% so that the increase in the mean value of the lamp voltage is not sufficient to detect the rectification effect in a sufficiently precise manner. All in all, therefore, the detection of the rectification effect by monitoring the lamp voltage is problematic.

In the case of the electronic ballast known from EP-A1-0 490 329 belonging to the applicant, a first resistor is connected in series with the primary winding of the filament-heating transformer. The current flowing through the primary winding and the first resistor generates a voltage at the resistor, which voltage is proportional to the current flowing through the heater filaments of the lamp. The voltage drop across the first resistor is evaluated by a control and regulating circuit arrangement in order to detect overvoltage or undervoltage. Identification of a rectification effect is not, however, described in this publication.

Identification of a rectification effect is, however, described in U.S. Pat. No. 5,023,516. For this purpose, a monitoring circuit arrangement is provided that comprises a series circuit arrangement consisting of two resistors and an inductor, with the series circuit arrangement being connected in parallel with a gas discharge lamp that is to be monitored. A thyristor, which is coupled to the inverter of the ballast, acts at the interconnection point between the one resistor and the inductor and thus evaluates the voltage dropping across the one resistor for the purpose of identifying the rectification effect. As soon as the voltage, which drops across the one resistor and which is proportional to the current flowing by way of the one resistor, has reached a specific limiting value, the thyristor is activated and consequently the inverter is switched off. The known monitoring circuit arrangement, however, only detects the presence of a rectification effect in one direction of polarity of the voltage dropping across the resistor.

SUMMARY OF THE INVENTION

The underlying object of the invention is to provide the known electronic ballast with a monitoring circuit arrangement with which the rectification effect can be detected in a more precise manner.

This object is achieved in accordance with the invention by means of an electronic ballast for operating at least one gas discharge lamp. The ballast includes an inverter having a load circuit which is connected to the inverter and to which a gas discharge lamp can be connected. The electronic ballast also includes a filament-heating transformer for preheating the lamp filaments of the gas discharge lamp. The primary winding of the transformer is connected in series with a first resistor in parallel with the gas discharge lamp. A monitoring circuit arrangement is provided for monitoring current flowing by way of the primary winding of the filament-heating transformer or a variable that is proportionally dependent upon such current. The interconnection point between the primary winding of the filament-heating transformer and the first resistor is connected to the monitoring circuit arrangement by way of a second resistor so that the voltage drop across the first resistor and the current which flows by way of the second resistor are fed as monitoring variables to the monitoring circuit arrangement. The monitoring circuit arrangement assesses, as a monitoring variable, the presence of the rectification effect in the gas discharge lamp in the case of a voltage drop across the first resistor which increases in a positive direction or a current flowing through the first resistor which increases in a positive direction as a function of the voltage drop across the first resistor, in that the monitoring circuit arrangement assesses, as a monitoring variable, the presence of the rectification effect in the gas discharge lamp in the case of a voltage drop across the first resistor which increases in a negative direction or a current flow through the first resistor which increases in a negative direction as a function of the current flow through the second resistor, and in that the monitoring circuit arrangement is constructed to respond to the presence of a rectification effect in the gas discharge lamp upon the monitoring variable exceeding a predetermined limiting value.

The solution in accordance with the invention thus guarantees that the rectification effect is detected in both directions of polarization of the voltage dropping across the first resistor and as a result with a high level of sensitivity.

The circuit arrangement in accordance with the present invention can be extended in a simple manner in that devices with two or more flames can be reliably monitored for the occurrence of a rectification effect in one of the gas discharge lamps.

The filament or heating current or the variable that is proportional to the heating current flowing by way of the primary winding of the filament-heating transformer is monitored in particular with the aid of a monitoring circuit arrangement which is of such a kind that, after identification of the rectification effect, it activates the inverter supplying the gas discharge lamp with an alternating voltage in order to change the frequency and/or the pulse duty factor of the alternating voltage delivered by the inverter and thus to reduce the power consumed by the gas discharge lamp. In this way, the glass bulb of the gas discharge lamp is reliably prevented from melting after the occurrence of the rectification effect.

Other advantageous and novel features of the invention are described and claimed herein.

BRIEF DESCRIPTION OF THE DRAWINGS

The invention is described in greater detail in the following with the aid of preferred exemplary embodiments and with reference to the enclosed drawing, in which.

DETAILED DESCRIPTION OF THE PREFERRED EMBODIMENTS

Figure 1:
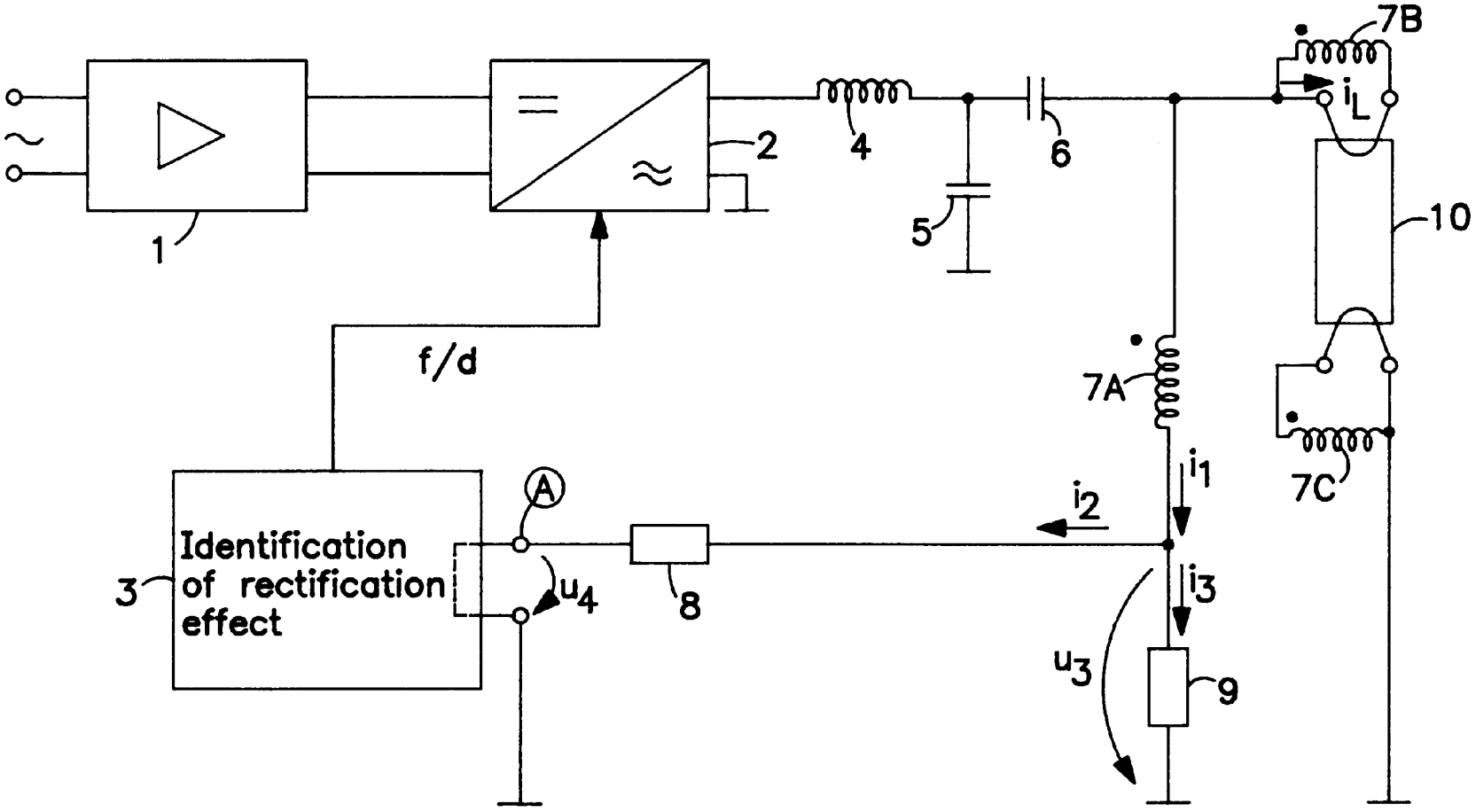
FIG. 1 shows a first exemplary embodiment of the electronic ballast in accordance with the invention for operating a gas discharge lamp.

FIG. 1 shows a first exemplary embodiment of the electronic ballast in accordance with the invention for operating a gas discharge lamp, wherein the inductor which is monitored and connected in parallel with the gas discharge lamp is formed by the primary winding of a filament-heating transformer. The solution in accordance with the invention generally consists in evaluating the current flowing by way of an inductor connected in parallel with the gas discharge lamp or a variable that is proportional thereto, since the asymmetries that occur in the lamp branch in the case of a rectification effect are transferred to the current flowing by way of this inductor.

The electronic ballast shown in FIG. 1 in the main has a rectifier circuit arrangement 1, an inverter 2, a monitoring circuit arrangement 3 and also a load circuit connected to the inverter 2 which inter alia contains a gas discharge lamp 10 which is to be operated and monitored for the occurrence of the rectification effect. The rectifier 1 is connected to a mains voltage source and converts the mains voltage into a rectified intermediate voltage which is fed to the inverter 2. The inverter 2 as a rule comprises two controllable switches (not shown), for example MOS-field effect transistors, which are alternately activated by means of a corresponding control circuit arrangement so that in each case one of the switches is switched on and the other is switched off. The two inverter switches are connected in a series circuit arrangement between a supply voltage and earth, in which case the load circuit containing the gas discharge lamp 10 is connected to the common junction between the two inverter switches. In addition to the gas discharge lamp 10, the load circuit comprises a series-resonant circuit with a resonant circuit coil 4 and a resonant circuit capacitor 5 which is connected to earth. Connected to the interconnection point between the resonant circuit capacitor 5 and the resonant circuit coil 4 there is a coupling capacitor 6 which is connected to one of the lamp filaments of the gas discharge lamp 10. On account of the fact that the switches of the inverter 2 are activated alternately, the rectified intermediate voltage is converted into a "chopped" high-frequency alternating voltage. This high-frequency alternating voltage is fed to the gas discharge lamp 10 by way of the series-resonant circuit.

Before the firing voltage is applied to the gas discharge lamp 10, the lamp electrodes of the gas discharge lamp 10 are preheated in order to extend the life of the gas discharge lamp. A filament-heating transformer having a primary winding 7A and two secondary windings 7B and 7C is provided for the purpose of preheating the gas discharge lamp 10. The primary winding is connected to the series resonant circuit, whilst the secondary windings are, in each case, connected in parallel with one of the lamp filaments. In this way it is possible to supply the lamp filaments with energy in the fired mode of operation as well. During the preheating operation, the frequency of the alternating voltage delivered by the inverter 2 is changed in relation to the resonant frequency of the series-resonant circuit in such a way that the voltage across the resonant-circuit capacitor 5 and thus across the gas discharge lamp 10 does not cause the gas discharge lamp 10 to be fired. In this case, a substantially constant current flows through the lamp electrodes of the gas discharge lamp 10 that are realized as filaments, whereby the lamp filaments are preheated. At the end of the preheating phase, the frequency of the alternating voltage delivered by the inverter 2 is shifted into the proximity of the resonant frequency of the series-resonant circuit, whereby the voltage applied to the resonant-circuit capacitor 5 and the gas discharge lamp 10 is increased so that the gas discharge lamp 10 is fired.

In accordance with the invention it is proposed that the primary current $i_1$ flowing by way of the primary winding 7A of the filament-heating transformer be monitored. To this end, connected in series with the primary winding 7A there is a resistor 9 which is connected to earth. A further resistor 8 leads from the interconnection point between the primary winding 7A and the resistor 9 to the monitoring circuit arrangement 3 which for its part is connected to earth. The function of the electronic ballast in accordance with the invention, as shown in FIG. 1, is described in greater detail in the following with reference to FIG. 2 and FIG. 3.

Figure 5:
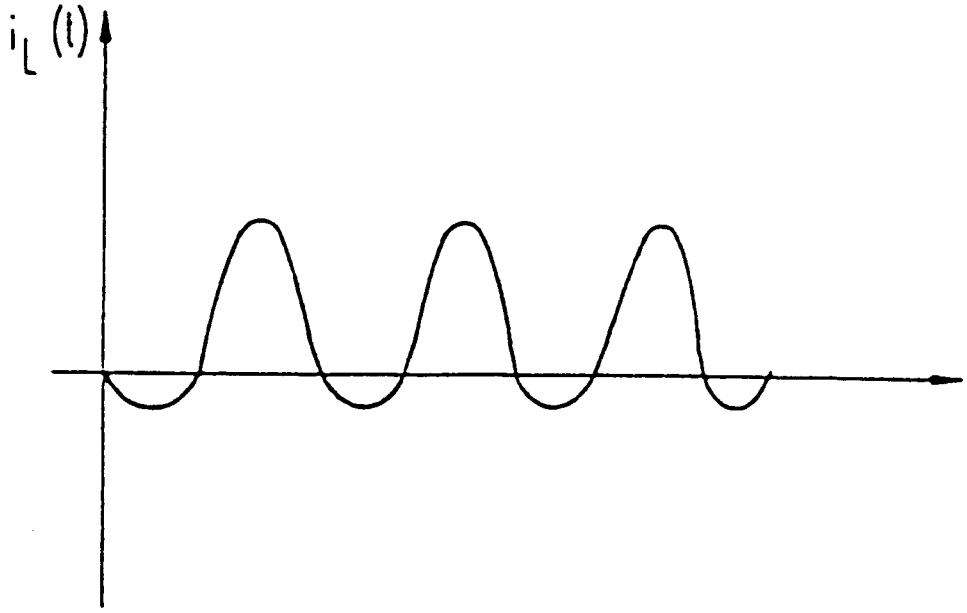
FIG. 5 shows the characteristic of the lamp current over the gas discharge path of a gas discharge lamp when the rectification effect occurs.

As shown in FIG. 5, when the rectification effect described at the beginning occurs, asymmetries result in the lamp current $i_L$ that flows by way of the gas discharge path of the gas discharge lamp 10. As soon as this asymmetrical current $i_L$ occurs in the lamp branch, the asymmetries are transferred to the primary current $i_1$ flowing by way of the primary winding 7A of the filament-heating transformer. In order to be able to detect and evaluate the asymmetries that occur in the primary current $i_1$, the primary current $i_1$ is fed by way of the resistor 9 to the monitoring circuit arrangement 3. In this connection, a distinction is to be made between two different cases, depending on whether the half-waves of the lamp current $i_L$ shown in FIG. 5 relate to the positive or negative half-waves. In other words, in accordance with the invention a distinction is made between the rectification effect that occurs in the one direction of the gas discharge lamp 10 and the rectification effect that occurs in the opposite direction.

For the case where on account of the rectification effect that occurs in the gas discharge lamp 10 a current $i_3$ that changes in a positive direction flows by way of the resistor 9, in accordance with the invention the rectification effect is detected by monitoring the voltage $u_3$ that drops across the resistor 9. FIG. 2*a* show the time characteristic of the voltage $u_3$ that drops across the resistor 9 in this case. On account of the different wear of the lamp electrodes that occurs as a result of the ageing of the lamp electrodes, in the course of time, as already described at the beginning, an excess of the positive half-waves in relation to the negative half-waves results in the voltage $u_3$ that drops across the resistor 9 or in the current $i_3$ flowing by way of the resistor 9 respectively. In the extreme case, over time the negative half-waves in the voltage and current characteristics of $u_3$ and $i_3$ respectively completely disappear so that the gas discharge lamp 10 acts as a rectifier. A threshold value $U_S$ can be defined by way of the resistance value of the resistor 9 and when this threshold value $U_S$ is exceeded the presence of the rectification effect is identified. In order to monitor the voltage $u_3$ dropping across the resistor 9, the monitoring circuit arrangement 3 is also connected to earth so that the monitoring point A of the monitoring circuit arrangement 3 cannot accept a potential that is more negative than the earth potential. FIG. 2*b* shows the characteristic of the potential $u_4$ that occurs at the monitoring point A. Since the potential $u_4$ cannot assume a more negative value than the earth potential, the voltage characteristic of $u_4$ only has positive half-waves that correspond to the positive half-waves of $u_3$. If one of these half-waves exceeds the predefined threshold value $U_S$, the monitoring circuit arrangement 3 interprets this as the occurrence of the rectification effect in the gas discharge lamp 10. FIG. 2*c* in a supplementary manner shows the current characteristic of the current $i_2$ flowing by way of the additional resistor 8. It can be seen from FIG. 2*c* that the current $i_2$ only occurs when the voltage $u_4$ applied at the monitoring point A is zero.

Figure 2:
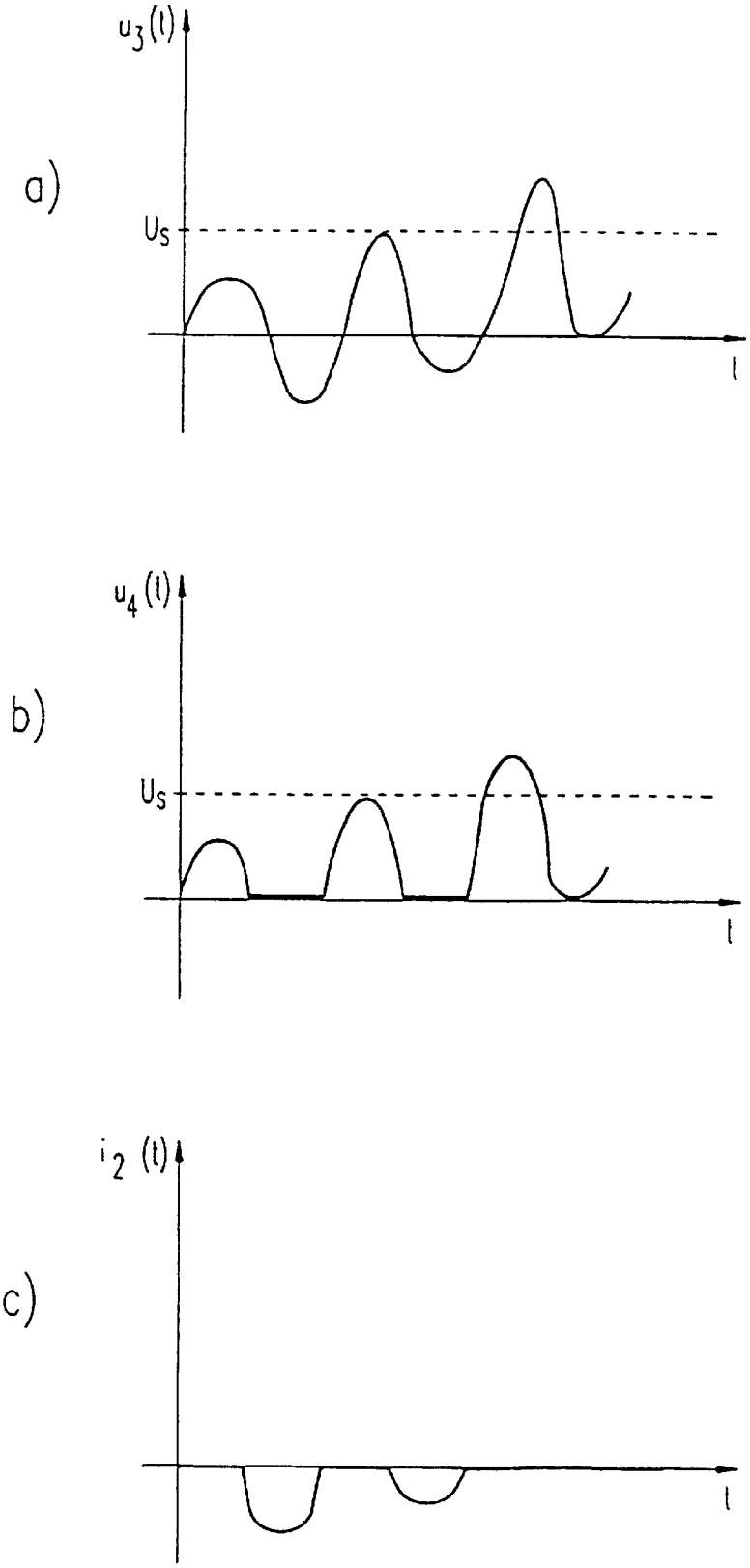
FIG. 2 shows voltage and current characteristics in the case of a heating current that increases in a positive direction in the circuit arrangement that is shown in FIG. 1.
Figure 3:
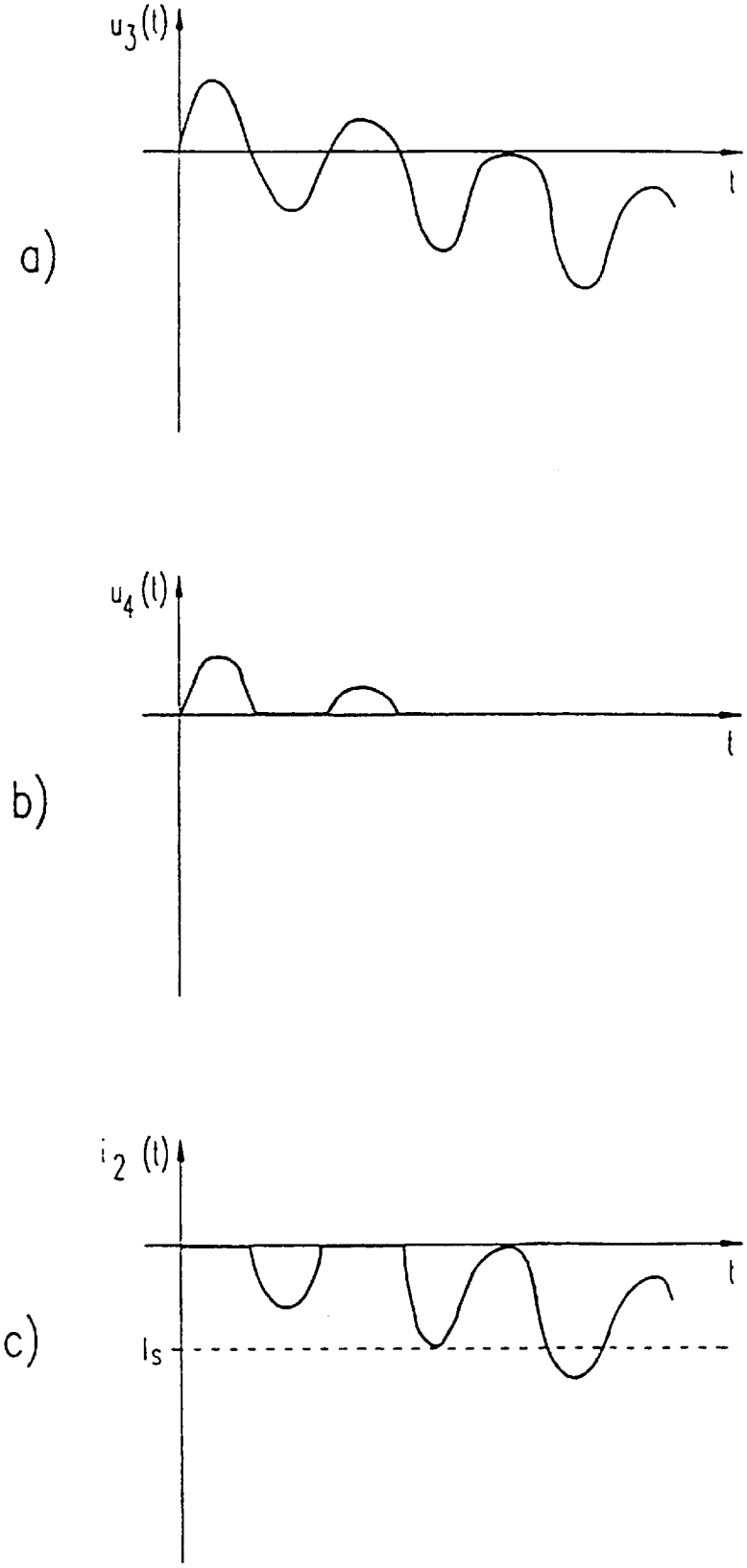
FIG. 3 shows voltage and current characteristics in the case of a heating current that increases in a negative direction in the circuit arrangement that is shown in FIG. 1.

FIG. 3 shows the corresponding voltage and current characteristics for the case where the previously described rectification effect in the gas discharge lamp 10 occurs in the opposite direction to the case described with respect to FIG. 2. In this case, the current $i_3$ flowing by way of the resistor 9 or the voltage $u_3$ dropping across the resistor 9 assume values which rise in a negative direction so that the negative half-waves are excessive in respect of the positive half-waves in the voltage characteristic and current characteristic of $u_3$ and $i_3$ respectively. In the extreme case in the course of time the positive half-waves disappear completely so that the gas discharge lamp 10 acts as a rectifier in the opposite direction to the direction described with reference to FIG. 2. In the same way as FIG. 2*b*, FIG. 3*b* also shows that the potential $u_4$ that occurs at the monitoring point A on account of the connection of the monitoring circuit arrangement 3 to earth can only assume positive values so that over time with the disappearance of the positive half-waves of the voltage $u_3$ dropping across the resistor 9 the voltage $u_4$ assumes the value zero. In order, nevertheless, to be able to identify the presence of the rectification effect in the gas discharge lamp 10 in this case, in accordance with the invention it is proposed that the current $i_2$ flowing by way of the resistor 8 be evaluated in this case. The current $i_2$ can only flow by way of the resistor 8 if the voltage $u_4$ that occurs at the monitoring point A assumes the value zero. For this reason, from the time at which the voltage $u_4$ completely disappears, the current $i_2$ can be monitored continuously by the monitoring circuit arrangement 3. The characteristic of the current $i_2$ is then changed in line with the half-waves of the voltage $u_3$ rising in the negative direction.

For this reason, the rectification effect acting in the other direction of the gas discharge lamp 10 can be identified by monitoring the current $i_2$ flowing by way of the resistor 8, if this current $i_2$ exceeds a predetermined limiting value $I_S$. This limiting value $I_S$ can be varied in particular by way of the value of the resistor 8. On the basis of the negative current values of the current $i_2$ represented in FIG. 3*c*, it can be seen in conjunction with FIG. 1 that the current $i_2$ flowing out from the monitoring circuit arrangement 3 by way of the monitoring point A is actually detected by the monitoring circuit arrangement 3. By simultaneously monitoring $u_3$ and also $i_2$, the monitoring circuit arrangement 3 can thus reliably identify the rectification effect—irrespective of the direction in which the rectification effect occurs in the gas discharge lamp 10.

The monitoring of $i_2$ and $u_3$ in order to determine whether the limiting value $I_S$ or $U_S$ respectively has been exceeded is advantageously effected by means of standard current and voltage comparators.

As soon as the monitoring circuit arrangement 3 has identified that the voltage $u_4$ applied at the monitoring point A has exceeded the predetermined limiting value $U_S$ or the current $i_2$ flowing by way of the monitoring point A has exceeded the predetermined limiting value $I_S$, the monitoring circuit arrangement 3 concludes that the rectification effect is present in the gas discharge lamp 10 and gives out a corresponding warning. The monitoring circuit arrangement 3 is advantageously connected to the inverter 2 and controls the operational performance of the inverter 2 after identification of a rectification effect in the gas discharge lamp 10 in such a way that the power consumed by the gas discharge lamp 10 is reduced. In particular, the monitoring circuit arrangement 3 controls the switching performance of the alternately switching switches of the inverter 2 in such a way that, for example, the frequency f of the switched-mode alternating voltage delivered by the inverter 2 is increased and/or the pulse duty factor d (that is, the relationship between the switch-on times of the two activated switches of the inverter 2) of the switched-mode alternating voltage is reduced so that the lamp current $i_L$ supplied to the gas discharge lamp 10 is reduced. In this way, excessive heating or melting of portions of the glass lamp bulb is reliably prevented. If applicable, the monitoring circuit arrangement 3 can also cause the inverter 2 to be switched off.

Figure 4:
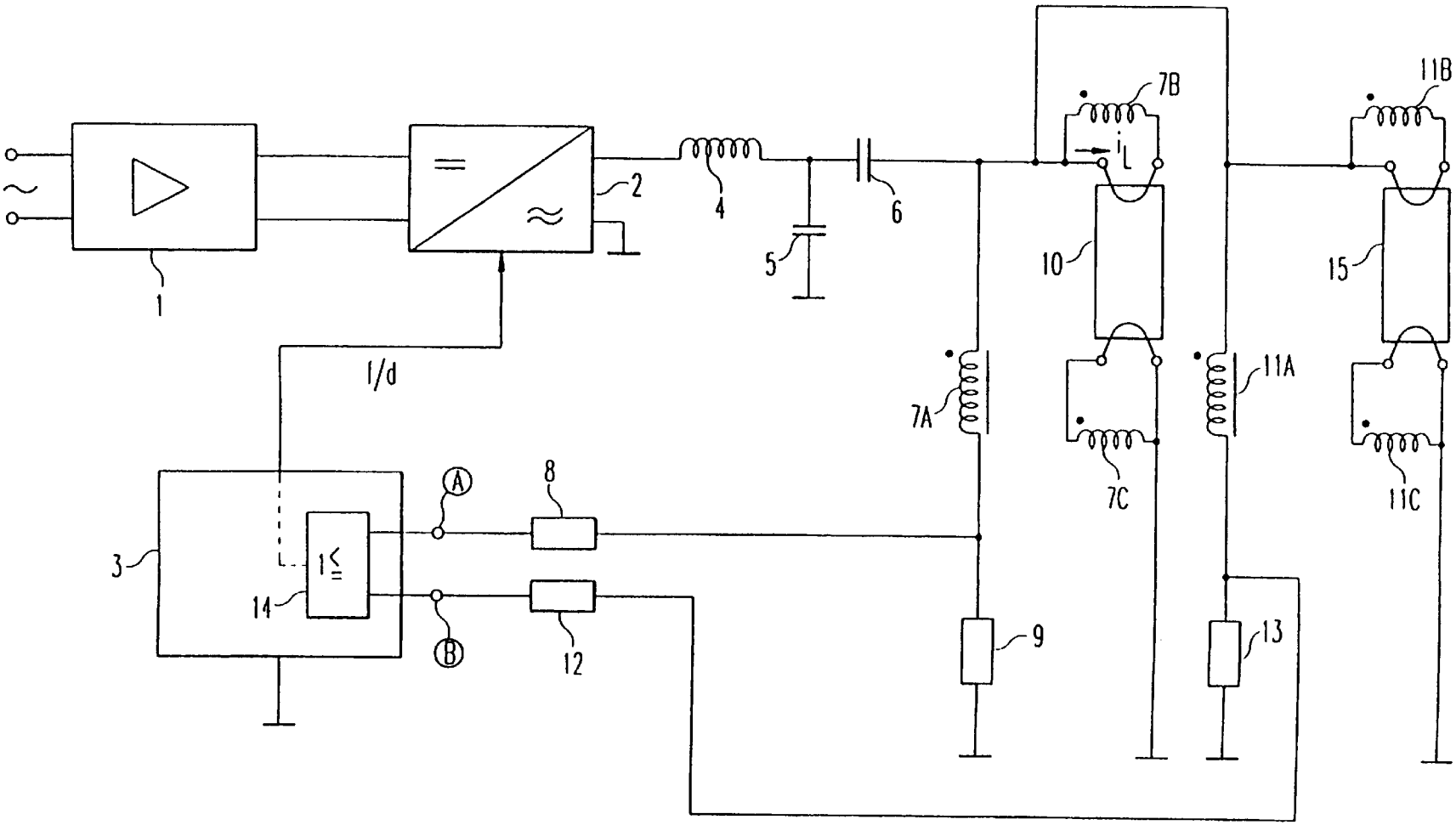
FIG. 4 shows a second exemplary embodiment of the electronic ballast in accordance with the invention.

FIG. 4 shows a second exemplary embodiment of the electronic ballast in accordance with the invention, with a two-lamp load circuit being represented in the figure. The second lamp circuit is connected up in a manner analogous to the first lamp circuit. The second lamp circuit likewise comprises a filament-heating transformer, the primary winding 11A of which is connected to the series-resonant circuit and the two secondary windings 11B and 11C of which are connected to the lamp filaments of a second gas discharge lamp 15. Connected in series with the primary winding 11A of the second filament-heating transformer there is a resistor 13, which is additionally connected to earth. A connection leads from the interconnection point between the primary winding 11A of the second filament-heating transformer and the resistor 13 to the monitoring circuit arrangement 3 by way of a resistor 12. The monitoring circuit arrangement 3 has an OR-circuit arrangement 14, the inputs of which are connected to the monitoring points A and B and also to the resistors 8 and 12. Each of the monitoring points A and B is, as explained with reference to FIGS. 2 and 3, monitored for the occurrence of a rectification effect in the gas discharge lamp 10 and 15 respectively. The OR-circuit arrangement 14 signals the presence of a rectification effect as soon as it is possible to identify the rectification effect in one of the two gas discharge lamps 10 and 15 by monitoring the monitoring points A and B. As in the case of the exemplary embodiment shown in FIG. 1, in accordance with FIG. 4 as well after a rectification effect has been identified the inverter 2 is activated in a corresponding manner in order to reduce the power consumed by the gas discharge lamps 10 and 15 connected to the inverter 2.

The monitoring circuit arrangement 3 is advantageously designed as an ASIC (Application Specific Integrated Circuit).

On account of the proposed manner, in accordance with the invention, of monitoring the heating current which flows by way of the primary windings 7A and 11A of the corresponding filament-heating transformers and the characteristic of which changes greatly when a rectification effect is present in the corresponding gas discharge lamp 10 and 15 respectively, it is possible to identify the rectification effect in the gas discharge lamp 10 and 15 with great precision and in a reliable manner. The circuit arrangement proposed in accordance with the invention can easily be extended by means of simple measures in terms of circuit engineering in order to monitor two or more gas discharge lamps.

What is claimed is:

1. Electronic ballast for operating at least one gas discharge lamp, said ballast comprising:

an inverter;

a load circuit connected to the inverter;

a gas discharge lamp connected to the load circuit, said gas discharge lamp having a filament-heating transformer for preheating the filaments of the gas discharge lamp;

a primary winding for said transformer being connected in series with a first resistor in parallel with the gas discharge lamp;

a monitoring circuit arrangement for monitoring the current flow through the primary winding of the filament-heating transformer, or a variable that is proportionally dependent upon such current;

an interconnection point between the primary winding of the filament-heating transformer and the first resistor being connected to the monitoring circuit arrangement by way of a second resistor so that the voltage drop across the first resistor and the current flow through the second resistor are fed as monitoring variables to the monitoring circuit arrangement;

said monitoring circuit arrangement being arranged to assess, as a monitoring variable, the presence of a rectification effect in the gas discharge lamp in the case of a voltage drop across the first resistor which increases in a positive direction or in the case of a current flowing through the first resistor which increases, in a positive direction as a function of the voltage drop across the first resistor;

said monitoring circuit arrangement further being arranged to assess, as a monitoring variable, the presence of a rectification effect in the gas discharge lamp in the case of a voltage drop across the first resistor which increases in a negative direction or a current flow through the first resistor which increases in a negative direction as a function of the current flow through the second resistor;

said monitoring circuit arrangement being constructed to indicate the presence of a rectification effect in the gas discharge lamp upon a monitoring variable exceeding a predetermined limiting value.

2. Electronic ballast according claim 1, wherein:

the monitoring circuit arrangement is an ASIC (Application Specific Integrated Circuit).

3. Electronic ballast according to claim 1, wherein:

a limiting value of the voltage across the first resistor, which represents the presence of a rectification effect in the gas discharge lamp, is determined by the resistance value of the first resistor and can be changed.

4. Electronic ballast according to one of claims 1 and 2, wherein:

the monitoring circuit arrangement and the first resistor are connected to ground.

5. Electronic ballast according to one of claims 1 and 2, wherein:

the filament-heating transformer has two secondary windings, connected respectively, to associated ones of the lamp filaments of the gas discharge lamp.

6. Electronic ballast according to one of claims 1 and 2, wherein:

the inverter includes two alternately activated switches which are connected in series and which are connected to be supplied with a direct voltage from a direct-voltage source;

the load circuit connected to the inverter contains a series-resonant circuit to which the at least one gas discharge lamp is connected;

and the monitoring circuit arrangement, upon identification of the rectification effect in the at least one gas discharge lamp, changes the frequency and/or the pulse duty factor of the alternating voltage delivered by the inverter in such a way that the power consumed by the at least one gas discharge lamp is reduced.

7. Electronic ballast according to claim 6, wherein:

after identification of the rectification effect in the at least one gas discharge lamp, the monitoring circuit arrangement increases the frequency of the alternating voltage delivered by the inverter and/or reduces the pulse duty factor thereof.

8. Electronic ballast according to one of claims 1 and 2, further including:

at least one further filament-heating transformer;

a series circuit arrangement comprising a primary winding of the at least one further filament-heating transformer and a further first resistor which is connected in parallel with a series circuit arrangement comprising the primary winding of the filament-heating transformer and the first resistor;

at least one further gas discharge lamp;

two secondary windings of the at least one further filament-heating transformer being connected to an associated one of the lamp filaments of the at least one further gas discharge lamp in such a way that the circuit arrangement which comprises the secondary windings of the at least one further filament-heating transformer and the lamp filaments of the at least one further gas discharge lamp are connected in parallel with a circuit arrangement which comprises the secondary windings of the filament-heating transformer and the lamp filaments of the gas discharge lamp;

and at least one further second resistor connected between the monitoring circuit arrangement and an interconnection point between the primary winding of the at least one further filament-heating transformer and the at least one further first resistor.

9. Electronic ballast according to claim 8, wherein:

the monitoring circuit arrangement includes an OR-circuit arrangement, the input terminals of said OR-circuit being connected to the second resistors so that the monitoring circuit arrangement concludes that the rectification effect is present in one of the gas discharge lamps if at least one of the variables fed to the monitoring circuit arrangement by way of the second resistors exceeds a predetermined limiting value.

10. Electronic ballast according to claim 9, wherein:

the monitoring circuit arrangement includes an OR-circuit arrangement, the input terminals of which are connected to the second resistors so that the monitoring circuit arrangement concludes that the rectification effect is present in one of the gas discharge lamps if at least one of the variables fed to the monitoring circuit arrangement by way of the second resistors exceeds a predetermined limiting value.

11. Electronic ballast according claim 9, wherein:

the inverter includes two alternately activated switches which are connected in series and which are connected to be supplied with a direct voltage from a direct-voltage source;

the load circuit connected to the inverter contains a series-resonant circuit to which the at least one gas discharge lamp is connected; and wherein:

the monitoring circuit arrangement, upon identification of the rectification effect in the at least one gas discharge lamp, changes the frequency and/or the pulse duty factor of the alternating voltage delivered by the inverter in such a way that the power consumed by the at least one gas discharge lamp is reduced.

12. Electronic ballast according to claim 11, wherein:

after identification of the rectification effect in the at least one gas discharge lamp, the monitoring circuit arrangement increases the frequency of the alternating voltage delivered by the inverter and/or reduces the pulse duty factor thereof.

13. Electronic ballast according to claims 1 or 2, wherein:

a limiting value of the current flowing through the second resistor, which represents the presence of a rectification effect in the gas discharge lamp, is determined by the resistance value of the second resistor and can be changed.

14. Electronic ballast according to claim 13, wherein:

the monitoring circuit arrangement includes an OR-circuit arrangement, the input terminals of which are connected to the second resistors so that the monitoring circuit arrangement concludes that the rectification effect is present in one of the gas discharge lamps if at least one of the variables fed to the monitoring circuit arrangement by way of the second resistors exceeds a predetermined limiting value.

15. Electronic ballast according to claim 13, wherein:

the monitoring circuit arrangement and the first resistor are connected to ground.

16. Electronic ballast according to claim 15, wherein:

the filament-heating transformer has two secondary windings, connected respectively, to associated ones of the lamp filaments of the gas discharge lamp.

17. Electronic ballast according to claim 15, and further including:

at least one further filament-heating transformer;

a series circuit arrangement comprising a primary winding of the at least one further filament-heating transformer and a further first resistor connected in parallel with a series circuit arrangement which comprises the primary winding of the filament-heating transformer and the first resistor;

at least one further gas discharge lamp, two secondary windings of the at least one further filament-heating transformer being connected to an associated one of the lamp filaments of the at least one further gas discharge lamp in such a way that the circuit arrangement which comprises the secondary windings of the at least one further filament-heating transformer and the lamp filaments of the at least one further gas discharge lamp are connected in parallel with a circuit arrangement which comprises the secondary windings of the filament-heating transformer and the lamp filaments of the gas discharge lamp; and at least one further second resistor connected between the monitoring circuit arrangement and an interconnection point between the primary winding of the at least one further filament-heating transformer and the at least one further first resistor.

18. Electronic ballast according to claim 15, wherein:

the inverter includes two alternately activated switches which are connected in series and which are connected to be supplied with a direct voltage from a direct-voltage source;

the load circuit connected to the inverter contains a series-resonant circuit to which the at least one gas discharge lamp is connected; and the monitoring circuit arrangement, upon identification of the rectification effect in the at least one gas discharge lamp, changes the frequency and/or the pulse duty factor of the alternating voltage delivered by the inverter in such a way that the power consumed by the at least one gas discharge lamp is reduced.

19. Electronic ballast according to claim 13, wherein:

the filament-heating transformer has two secondary windings, connected respectively, to associated ones of the lamp filaments of the gas discharge lamp.

20. Electronic ballast according to claim 19, wherein:

the inverter includes two alternately activated switches which are connected in series and which are connected to be supplied with a direct voltage from a direct-voltage source;

the load circuit connected to the inverter contains a series-resonant circuit to which the at least one gas discharge lamp is connected; and the monitoring circuit arrangement, upon identification of the rectification effect in the at least one gas discharge lamp, changes the frequency and/or the pulse duty factor of the alternating voltage delivered by the inverter in such a way that the power consumed by the at least one gas discharge lamp is reduced.

21. Electronic ballast according to claim 19, wherein:

the monitoring circuit arrangement includes an OR-circuit arrangement, the input terminals of which are connected to the second resistors so that the monitoring circuit arrangement concludes that the rectification effect is present in one of the gas discharge lamps if at least one of the variables fed to the monitoring circuit arrangement by way of the second resistors exceeds a predetermined limiting value.

22. Electronic ballast according to one of claims 15 and 19, further including:

at least one further filament-heating transformer;

a series circuit arrangement comprising a primary winding of the at least one further filament-heating transformer and a further first resistor connected in parallel with a series circuit arrangement which comprises the primary winding of the filament-heating transformer and the first resistor;

at least one further gas discharge lamp, two secondary windings of the at least one further filament-heating transformer being connected to an associated one of the lamp filaments of the at least one further gas discharge lamp in such a way that the circuit arrangement which comprises the secondary windings of the at least one further filament-heating transformer and the lamp filaments of the at least one further gas discharge lamp are connected in parallel with a circuit arrangement which comprises the secondary windings of the filament-heating transformer and the lamp filaments of the gas discharge lamp; and at least one further second resistor connected between the monitoring circuit arrangement and an interconnection point between the primary winding of the at least one further filament-heating transformer and the at least one further first resistor.

23. Electronic ballast according to claim 22, further including:

at least one further filament-heating transformer, a series circuit arrangement comprising a primary winding of the at least one further filament-heating transformer and a further first resistor connected in parallel with a series circuit arrangement which comprises the primary winding of the filament-heating transformer and the first resistor, at least one further gas discharge lamp, two secondary windings of the at least one further filament-heating transformer being connected to an associated one of the lamp filaments of the at least one further gas discharge lamp in such a way that the circuit arrangement which comprises the secondary windings of the at least one further filament-heating transformer and the lamp filaments of the at least one further gas discharge lamp are connected in parallel with a circuit arrangement which comprises the secondary windings of the filament-heating transformer and the lamp filaments of the gas discharge lamp; and at least one further second resistor connected between the monitoring circuit arrangement and an interconnection point between the primary winding of the at least one further filament-heating transformer and the at least one further first resistor.

* * * * *